US011143002B2

(12) United States Patent
Cox et al.

(10) Patent No.: US 11,143,002 B2
(45) Date of Patent: Oct. 12, 2021

(54) DOWNHOLE TOOL FOR GRAVEL PACKING A WELLBORE

(71) Applicant: SCHLUMBERGER TECHNOLOGY CORPORATION, Sugar Land, TX (US)

(72) Inventors: Chase D. Cox, Radford, VA (US); Kevin Beranger, Houston, TX (US); Andrew Dorban, Houston, TX (US); Michael Huh, Pearland, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 22 days.

(21) Appl. No.: 16/483,261

(22) PCT Filed: Feb. 1, 2018

(86) PCT No.: PCT/US2018/016342
§ 371 (c)(1),
(2) Date: Aug. 2, 2019

(87) PCT Pub. No.: WO2018/144669
PCT Pub. Date: Aug. 9, 2018

(65) Prior Publication Data

US 2020/0011160 A1 Jan. 9, 2020

Related U.S. Application Data

(60) Provisional application No. 62/453,875, filed on Feb. 2, 2017.

(51) Int. Cl.
*E21B 43/04* (2006.01)
*E21B 34/08* (2006.01)

(52) U.S. Cl.
CPC ..... *E21B 43/04* (2013.01); *E21B 34/08* (2013.01)

(58) Field of Classification Search
CPC ..... E21B 43/04
See application file for complete search history.

(56) References Cited

U.S. PATENT DOCUMENTS 4,423,773 A 1/1984 Stout
4,428,428 A 1/1984 Smyrl et al.
(Continued)

FOREIGN PATENT DOCUMENTS

RU 2118746 C1 9/1998
WO 2013009773 A1 1/2013
(Continued)

OTHER PUBLICATIONS

Aviles, et al., "Degradable Frac Ball Holds Solution to Persistent Problem in Fracturing", Journal of Petroleum Technology; Society of Petroleum Engineers, Nov. 2013, pp. 32-33.
(Continued)

*Primary Examiner* — Taras P Bemko
(74) *Attorney, Agent, or Firm* — Kelly McKinney; Michael Dae

(57) ABSTRACT

A downhole tool includes a base pipe having an opening formed radially-therethrough. The downhole tool also includes a valve positioned at least partially within the opening. The valve includes a dissolvable insert and an impediment. The dissolvable insert prevents the impediment from contacting a seat of the valve such that the valve permits fluid flow in both axial directions through the valve. After the dissolvable insert dissolves, the impediment contacts the seat such that the valve permits fluid flow in one axial direction through the valve but prevents fluid flow in the opposing axial direction through the valve.

14 Claims, 9 Drawing Sheets

(56) References Cited

U.S. PATENT DOCUMENTS

| | | | |
|---|---|---|---|
| 4,733,723 | A | 3/1988 | Callegari, Sr. |
| 5,341,880 | A | 8/1994 | Thorstensen et al. |
| 5,917,489 | A | 6/1999 | Thurlow et al. |
| 6,041,803 | A | 3/2000 | De Almeida et al. |
| 6,047,310 | A | 4/2000 | Kamakura et al. |
| 6,176,307 | B1 | 1/2001 | Danos et al. |
| 6,371,210 | B1 | 4/2002 | Bode et al. |
| 6,427,164 | B1 | 7/2002 | Reilly |
| 6,505,682 | B2 | 1/2003 | Brockman |
| 6,622,794 | B2 | 9/2003 | Zisk, Jr. |
| 6,654,787 | B1 | 11/2003 | Aronson et al. |
| 6,679,949 | B2 | 1/2004 | De Almeida |
| 6,691,156 | B1 | 2/2004 | Drummond et al. |
| 6,716,268 | B2 | 4/2004 | Molyneux et al. |
| 6,721,785 | B1 | 4/2004 | Raghunandan |
| 6,832,246 | B1 | 12/2004 | Quine |
| 6,868,498 | B1 | 3/2005 | Katsikas |
| 7,100,686 | B2 | 9/2006 | Wittrisch |
| 7,185,706 | B2 | 3/2007 | Freyer |
| 7,290,606 | B2 | 11/2007 | Coronado et al. |
| 7,409,999 | B2 | 8/2008 | Henriksen et al. |
| 7,523,787 | B2 | 4/2009 | Richards et al. |
| 7,708,068 | B2 | 5/2010 | Halley, Jr. |
| 7,789,145 | B2 | 9/2010 | Patel |
| 7,814,973 | B2 | 10/2010 | Dusterhoft et al. |
| 7,828,067 | B2 | 11/2010 | Scott et al. |
| 7,958,939 | B2 | 6/2011 | Talley |
| 7,971,642 | B2 | 7/2011 | Yeh et al. |
| 7,984,760 | B2 | 7/2011 | Haeberle et al. |
| 7,987,909 | B2 | 8/2011 | Pineda et al. |
| 8,127,831 | B2 | 3/2012 | Haeberle et al. |
| 8,453,746 | B2 | 6/2013 | Hailey, Jr. et al. |
| 8,485,265 | B2 | 7/2013 | Marya et al. |
| 8,622,125 | B2 | 1/2014 | Weirich et al. |
| 9,771,780 | B2 | 9/2017 | Langlais |
| 10,100,606 | B2 | 10/2018 | Langlais |
| 10,113,390 | B2 | 10/2018 | Langlais et al. |
| 10,227,849 | B2 | 3/2019 | Huh et al. |
| 2001/0049745 | A1 | 12/2001 | Schoeffler |
| 2001/0051991 | A1 | 12/2001 | Beyda et al. |
| 2002/0079099 | A1 | 6/2002 | Hurst et al. |
| 2002/0104655 | A1 | 8/2002 | Hurst et al. |
| 2002/0129111 | A1 | 9/2002 | Cooper |
| 2002/0138581 | A1 | 9/2002 | MacIntosh et al. |
| 2003/0014490 | A1 | 1/2003 | Bates et al. |
| 2003/0029614 | A1 | 2/2003 | Michel |
| 2003/0097412 | A1 | 5/2003 | Chow |
| 2003/0111224 | A1 | 6/2003 | Hailey, Jr. et al. |
| 2003/0115280 | A1 | 6/2003 | Quine et al. |
| 2004/0020832 | A1 | 2/2004 | Richards et al. |
| 2004/0073619 | A1 | 4/2004 | Gilhuly et al. |
| 2004/0140089 | A1 | 7/2004 | Gunneroed |
| 2005/0072576 | A1 | 4/2005 | Henriksen et al. |
| 2005/0082060 | A1 | 4/2005 | Ward et al. |
| 2006/0041392 | A1 | 2/2006 | Korske |
| 2006/0042798 | A1 | 3/2006 | Badalamenti et al. |
| 2006/0073986 | A1 | 4/2006 | Jones et al. |
| 2006/0237197 | A1 | 10/2006 | Dale et al. |
| 2007/0044962 | A1 | 3/2007 | Tibbles |
| 2007/0246213 | A1 | 10/2007 | Hailey |
| 2008/0142227 | A1 | 6/2008 | Yeh et al. |
| 2008/0283238 | A1 | 11/2008 | Richards et al. |
| 2008/0314589 | A1 | 12/2008 | Guignard et al. |
| 2009/0008078 | A1 | 1/2009 | Patel |
| 2009/0101354 | A1 | 4/2009 | Holmes et al. |
| 2009/0140133 | A1 | 6/2009 | Abney |
| 2009/0151025 | A1 | 6/2009 | Evans |
| 2009/0151925 | A1 | 6/2009 | Richards et al. |
| 2009/0173390 | A1 | 7/2009 | Slupphaug et al. |
| 2009/0173490 | A1 | 7/2009 | Dusterhoft et al. |
| 2009/0301729 | A1 | 12/2009 | Makogon et al. |
| 2010/0032158 | A1 | 2/2010 | Dale et al. |
| 2010/0051262 | A1 | 3/2010 | Dusterhoft et al. |
| 2010/0059232 | A1 | 3/2010 | Langlais et al. |
| 2010/0258300 | A1 | 10/2010 | Shoemate |
| 2011/0011586 | A1 | 1/2011 | Dusterhoft et al. |
| 2011/0073308 | A1 | 3/2011 | Assal et al. |
| 2011/0094742 | A1 | 4/2011 | Badalamenti et al. |
| 2011/0132616 | A1 | 6/2011 | Yeh et al. |
| 2011/0139465 | A1 | 6/2011 | Tibbles et al. |
| 2011/0192607 | A1 | 8/2011 | Hofman et al. |
| 2011/0198097 | A1 | 8/2011 | Moen |
| 2011/0203793 | A1 | 8/2011 | Tibbles |
| 2011/0239754 | A1 | 10/2011 | Dyer et al. |
| 2011/0303420 | A1 | 12/2011 | Thorkildsen et al. |
| 2012/0000653 | A1 | 1/2012 | Panga et al. |
| 2012/0067588 | A1 | 3/2012 | Awid et al. |
| 2012/0305243 | A1 | 12/2012 | Hallundbæk et al. |
| 2013/0014953 | A1 | 1/2013 | Van Petegem |
| 2013/0037974 | A1 | 2/2013 | Nishikawa et al. |
| 2013/0081800 | A1 | 4/2013 | Riisem et al. |
| 2013/0092394 | A1 | 4/2013 | Holderman et al. |
| 2013/0139465 | A1 | 6/2013 | Kuryk et al. |
| 2013/0228341 | A1 | 9/2013 | Fripp et al. |
| 2013/0319664 | A1 | 12/2013 | McNamee et al. |
| 2014/0014357 | A1 | 1/2014 | Riisem |
| 2014/0076580 | A1 | 3/2014 | Holderman et al. |
| 2015/0013582 | A1 | 1/2015 | Osanai et al. |
| 2015/0027700 | A1 | 1/2015 | Riisem et al. |
| 2015/0198016 | A1 | 7/2015 | Langlais |
| 2015/0308238 | A1 | 10/2015 | Langlais |
| 2015/0308239 | A1 | 10/2015 | Langlais et al. |
| 2015/0368999 | A1 | 12/2015 | Massa de Campos et al. |
| 2016/0215595 | A1 | 7/2016 | Lopez et al. |
| 2017/0342809 | A1 | 11/2017 | Huh et al. |
| 2018/0023350 | A1 | 1/2018 | Lebedeva et al. |
| 2018/0328139 | A1* | 11/2018 | Mhaskar ..... E21B 34/085 |

FOREIGN PATENT DOCUMENTS

| | | | |
|---|---|---|---|
| WO | 2013187878 | A1 | 12/2013 |
| WO | 2014046799 | A1 | 3/2014 |
| WO | 2014126587 | A1 | 8/2014 |

OTHER PUBLICATIONS

Schlumberger, "Elemental Degradable Technology", [http://www.slb.com/services/completions/completion_products/multistagestimulation_systems/elementals.aspx], 2013, 3 pages.

Schlumberger, "Elemental Degradable Technolgy Frac Balls", [slb.com/elemental], 2013, 2 pages.

Flow Conditioners of different mixer types downloaded from [http://www.stamixco-usa.com/plug-flowreactors], on Nov. 23, 2018, 3 pages.

Brasien, B. J. et al., "Experimental investigation of terrain slugging formation, evolution and potential for mitigation", 16th International Conference on Multiphase Production Technology, 2013, BHR Group., pp. 399-414.

Theuveny, B. C. et al., "Integrated Approach to Simulation of Near-Wellbore and Wellbore Cleanup", SPE 166509, 2013 SPE Annual Technical Conference and Exhibition, New Orleans, Louisiana, U.S.A., pp. 1-28.

International Search Report and Written Opinion of International Patent Application No. PCT/2018/016342 dated May 14, 2018, 16 pages.

International Preliminary Report on Patentability of International Patent Application No. PCT/2018/016342 dated Aug. 15, 2019, 14 pages.

* cited by examiner

DOWNHOLE TOOL FOR GRAVEL PACKING A WELLBORE

BACKGROUND

In gravel packing operations, one or more screens are positioned in a wellbore, and a gravel slurry is pumped into an annulus between the screens and the wellbore wall. The gravel slurry includes a plurality of gravel particles dispersed in a carrier fluid. The carrier fluid separates from the particles (i.e., dehydration) and flows through the screens and back up to the surface, leaving the gravel particles packed in the annulus. When hydrocarbon fluid is produced from the surrounding formation, the packed gravel particles may prevent sand in the hydrocarbon fluid from flowing therethrough.

Currently, downhole tools featuring the combination of alternate path screens and inflow control devices ("ICDs") are used for gravel packing and production. However, one of the challenges associated with the merger of these two technologies is managing the dehydration of the gravel slurry. In gravel packing applications with alternate path screens, the gravel slurry flows through shunt tubes once bridging has occurred in the annulus. The dehydration of the gravel slurry is then achieved by having the carrier fluid flow through the screens and the ICDs, leaving the gravel particles packed in the annulus.

While the ICDs are beneficial during production, the volumetric flow rate of the carrier fluid through the ICDs during gravel packing may be insufficient to obtain reasonable pumping times (e.g., low flow rates due to pressure limitation) for gravel packing an entire production zone.

SUMMARY

This summary is provided to introduce a selection of concepts that are further described below in the detailed description. This summary is not intended to identify key or essential features of the claimed subject matter, is it intended to be used as an aid in limiting the scope of the claimed subject matter.

A downhole tool includes a base pipe having an opening formed radially-therethrough. The downhole tool also includes a valve positioned at least partially within the opening. The valve includes a dissolvable insert and an impediment. The dissolvable insert prevents the impediment from contacting a seat of the valve such that the valve permits fluid flow in both axial directions through the valve. After the dissolvable insert dissolves, the impediment contacts the seat such that the valve permits fluid flow in one axial direction through the valve but prevents fluid flow in the opposing axial direction through the valve.

In another embodiment, the downhole tool includes a first base pipe having a first opening formed radially-therethrough. An inflow control device is positioned at least partially in the first opening. A screen is coupled to the first base pipe and positioned radially-outward from the first base pipe. A second base pipe is coupled to the first base pipe. The second base pipe has a second opening formed radially-therethrough. A valve is positioned at least partially in the second opening. The valve includes a dissolvable insert and an impediment. The dissolvable insert prevents the impediment from contacting a seat of the valve such that the valve permits fluid flow in both axial directions through the valve. After the dissolvable insert dissolves, the impediment contacts the seat such that the valve permits fluid flow in one axial direction through the valve but prevents fluid flow in the opposing axial direction through the valve.

A method for gravel packing a wellbore is also disclosed. The method includes running a downhole tool into a wellbore. The downhole tool includes a base pipe having a first opening and a second opening formed radially-therethrough. An inflow control device is positioned at least partially in the first opening, and a valve is positioned at least partially in the second opening. The downhole tool also includes a screen positioned radially-outward from the first opening, the second opening, or both. A gravel slurry is pumped into the wellbore. The gravel slurry includes particles dispersed in a carrier fluid. The carrier fluid flows through the screen. A first portion of the carrier fluid flows through the inflow control device, and a second portion of the carrier fluid flows through the valve. After a dissolvable insert in the valve dissolves, an impediment in the valve prevents fluid through the valve in one direction.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying figures. In the following detailed description, numerous specific details are set forth in order to provide a thorough understanding of the present disclosure. However, it will be apparent to one of ordinary skill in the art that the system and method disclosed herein may be practiced without these specific details.

Figure 1:
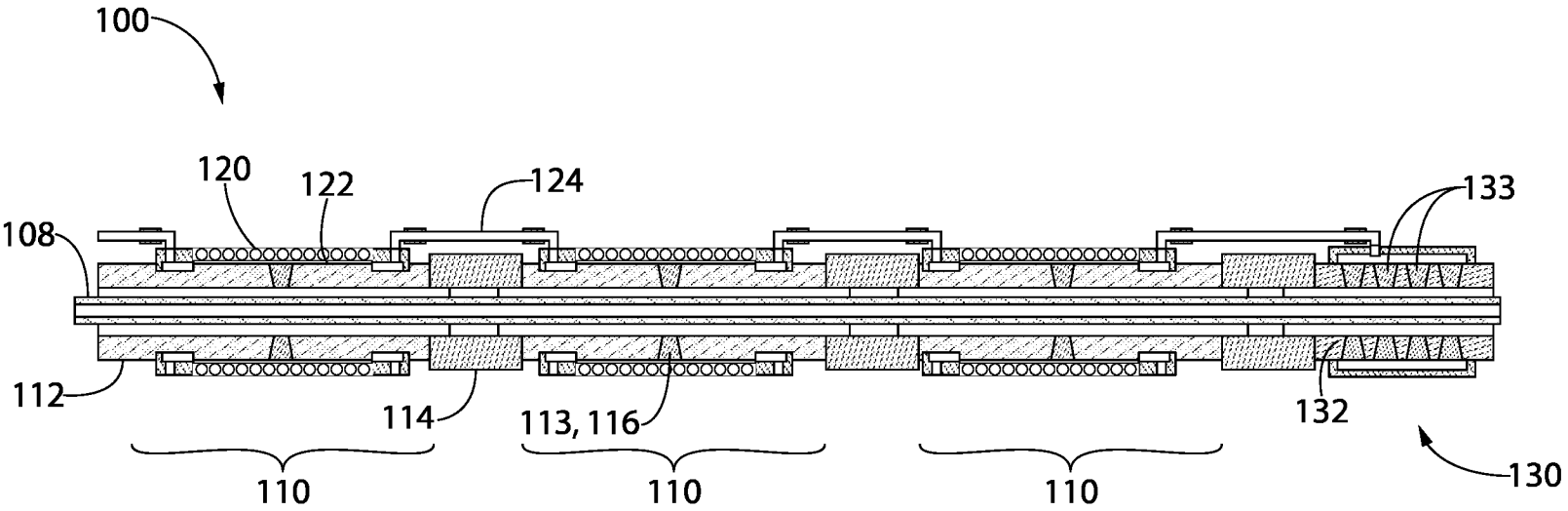
FIG. 1 illustrates a cross-sectional side view of a downhole tool, according to an embodiment.

FIG. 1 illustrates a cross-sectional side view of a downhole tool 100, according to an embodiment. The downhole tool 100 may be or include at least a portion of a completion assembly that may be positioned in a wellbore in a subterranean formation. The downhole tool 100 may include a wash pipe 108. The downhole tool 100 may also include one or more completion segments (three are shown: 110) that are positioned radially-outward from the wash pipe 108. Each completion segment 110 may include a base pipe 112. The completion segments 110 (e.g., the base pipes 112 of the completion segments 110) may be coupled together using couplings 114. Each base pipe 112 may have one or more openings 113 formed radially-therethrough. The openings 113 may have inflow control devices ("ICDs") 116 positioned at least partially therein to balance inflow throughout the length of the downhole tool 100, restrict water and/or gas production, or a combination thereof.

Each completion segment 110 may also include one or more screens 120. The screens 120 may be coupled to and positioned radially-outward from the base pipes 112. A drainage layer 122 may be formed between each base pipe 112 and corresponding screen 120. In at least one embodiment, the drainage layers 122 may be placed in fluid communication with one another via shunt tubes 124. For example, fluid may flow from the drainage layer 122 of one completion segment 110, through a shunt tube 124, and into the drainage layer 122 of another completion segment 110. The shunt tubes 124 may be positioned radially-outward from the base pipes 112 and/or the couplings 114.

The downhole tool 100 may also include a return flow unit 130. The return flow unit 130 may also be positioned radially-outward from the wash pipe 108. The return flow unit 130 may be coupled to one or more of the completion segments 110 (e.g., using a coupling 114). As shown, the return flow unit 130 may be positioned axially-below one of the completion segments 110; however, in other embodiments, the return flow unit 130 may be positioned axially-above one of the completion segments 110 or axially-between two completion segments 110.

The return flow unit 130 may include a base pipe 132. The base pipe 132 may also have one or more openings 133 formed radially-therethrough. The base pipe 132 of the return flow unit 130 may have more openings 133 per unit length than the base pipes 112 of the completion segments 110. The openings 133 in the base pipe 132 of the return flow unit 130 may have a greater aggregate surface area than the openings 113 in of the base pipe(s) 112 of one or more of the completion segments 110. As a result, when not obstructed, the openings 133 in the base pipe 132 may permit a greater volumetric flow rate therethrough than the openings 113 in the base pipe(s) 112.

Figure 2:
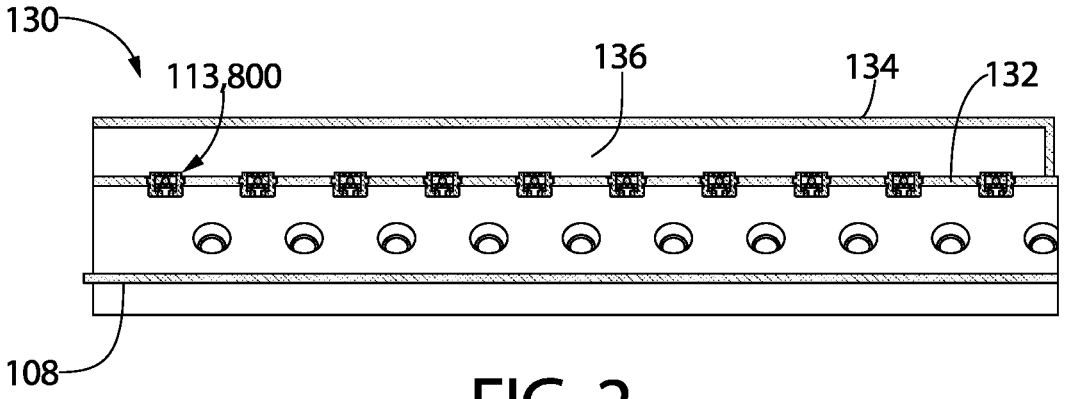
FIG. 2 illustrates a cross-sectional side view of a portion of a return flow unit of the downhole tool, according to an embodiment.

FIG. 2 illustrates a cross-sectional side view of a portion of the return flow unit 130, according to an embodiment. The return flow unit 130 may include a housing 134 positioned radially-outward from the base pipe 132. The housing 134 may be solid (i.e., have no openings formed radially-therethrough). In at least one embodiment, fluid may be introduced into an annulus 136 between the base pipe 132 and the housing 134 through one or more of the shunt tubes 124. Thus, the shunt tubes 124 may be configured to introduce fluid from one or more (e.g., three as shown in FIG. 1) completion segments 110 into the annulus 136 of the return flow unit 130.

One or more of the openings 133 in the base pipe 132 may have a valve 800 positioned at least partially therein. Each valve 800 may include a dissolvable insert that dissolves when placed in contact with a predetermined fluid for a predetermined amount of time. The predetermined fluid may be or include an acid, oil, water, or the like. The predetermined amount of time may be less than or equal to about 1 week, less than or equal to about 3 days, less than or equal to about 1 day, less than or equal to about 12 hours, less than or equal to about 3 hours, or less than or equal to about 1 hour.

Figure 3:
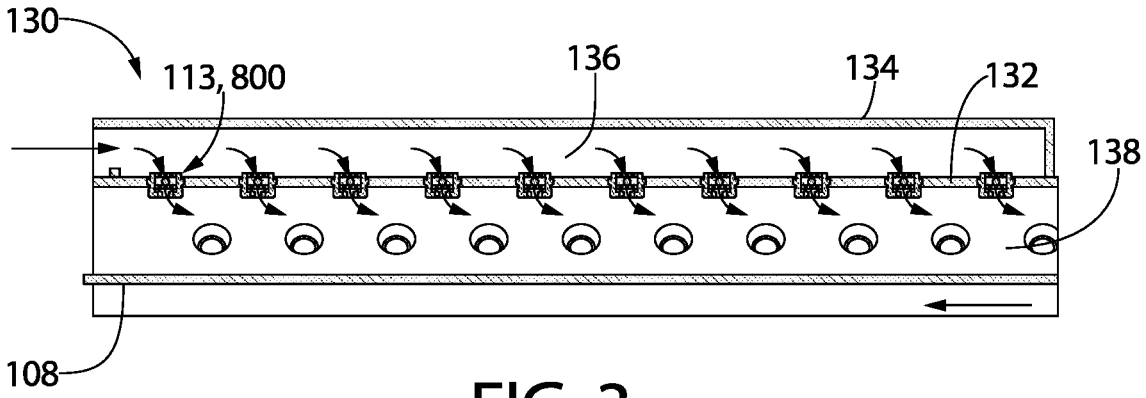
FIG. 3 illustrates the cross-sectional side view of the return flow unit before a dissolvable insert has dissolved, according to an embodiment.

FIG. 3 illustrates a cross-sectional side view of the return flow unit 130 before the dissolvable inserts in the valves 800 have dissolved, according to an embodiment. As shown by the arrows, before the dissolvable inserts have dissolved, fluid in the annulus 136 between the base pipe 132 and the housing 134 may flow radially-inward through the openings 133 and into another annulus 138 between the wash pipe 108 and the base pipe 132.

Figure 4:
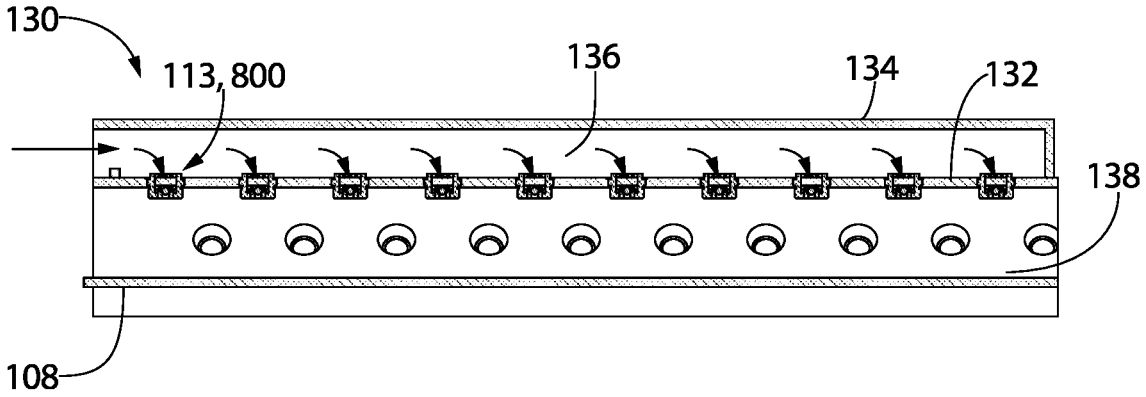
FIG. 4 illustrates the cross-sectional side view of the return flow unit after the dissolvable insert has dissolved, according to an embodiment.

FIG. 4 illustrates a cross-sectional side view of the return flow unit 130 after the dissolvable inserts in the valves 800 have dissolved, according to an embodiment. As shown by the arrows, after the dissolvable inserts have dissolved, fluid in the annulus 136 between the base pipe 132 and the housing 134 may be prevented from flowing through the openings 133 and into the annulus 138 between the wash pipe 108 and the base pipe 132. After the dissolvable inserts have dissolved, the valves 800 may function as check valves that permit fluid flow in a radially-outward direction but prevent fluid flow in a radially-inward direction.

Figure 5:
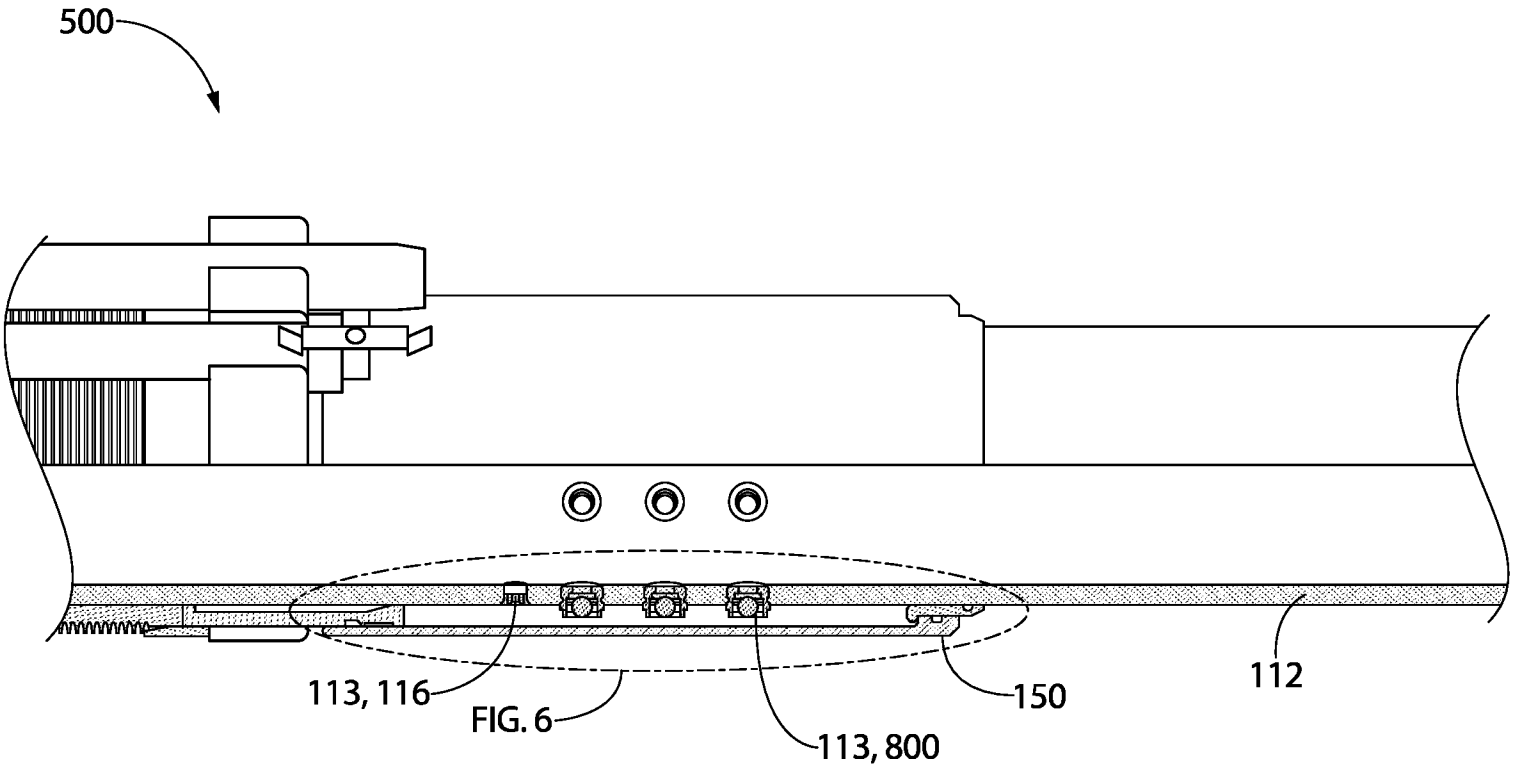
FIG. 5 illustrates a cross-sectional side view of another downhole tool, according to an embodiment.
Figure 6:
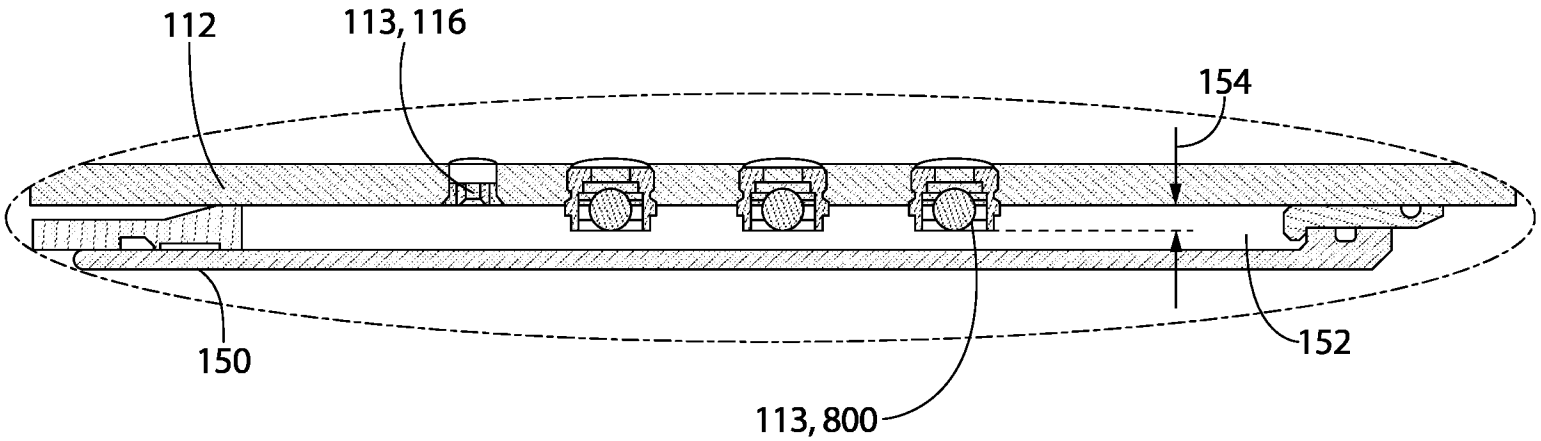
FIG. 6 illustrates an enlarged portion of the downhole tool shown in FIG. 5, according to an embodiment.

FIG. 5 illustrates a cross-sectional side view of another downhole tool 500, and FIG. 6 illustrates an enlarged portion of the downhole tool 500 shown in FIG. 5, according to an embodiment. The downhole tool 500 is similar to the downhole tool 100, and the same reference numbers are used where applicable. For example, the downhole tool 500 may include a base pipe 112 having one or more openings 113 formed radially-therethrough. As shown, one or more of the openings 113 may have an ICD 116 positioned (e.g., threaded) at least partially therein, and one or more of the openings 113 may have a valve 800 positioned (e.g., threaded) at least partially therein. When the ICD(s) 116 and valves 800 are in the same base pipe 112, the return flow unit 130 and/or the shunt tubes 124 may be omitted. More of the openings 113 may have valves 800 positioned therein than ICDs 116. At least a portion of each of the valves 800 may extend radially-outward from the base pipe 112 and into an annulus 152 formed radially-between the base pipe 112 and a surrounding housing 150. A gap 154 may exist radially-between the valves 800 and the housing 150.

Figure 7:
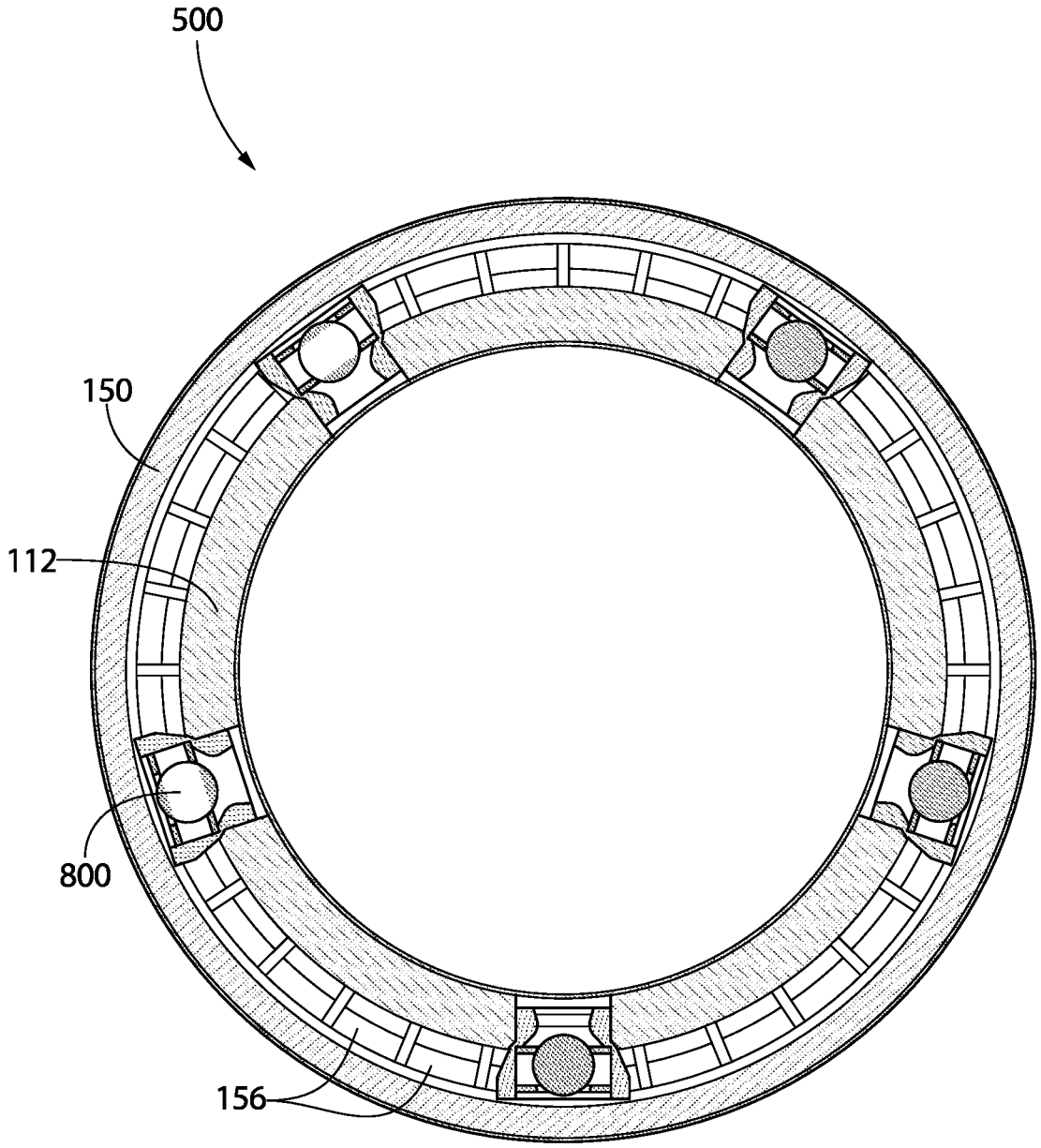
FIG. 7 illustrates a cross-sectional view taken through line 7-7 in FIG. 5, according to an embodiment.

FIG. 7 illustrates a cross-sectional view of the downhole tool 500 taken through line 7-7 in FIG. 5, according to an embodiment. The valves 800 may be circumferentially-offset from one another around the base pipe 112. A plurality of axial rib wires 156 may also be positioned circumferentially-around the base pipe 112. The rib wires 156 may be positioned radially-between the base pipe 112 and the housing 150.

Figure 8:
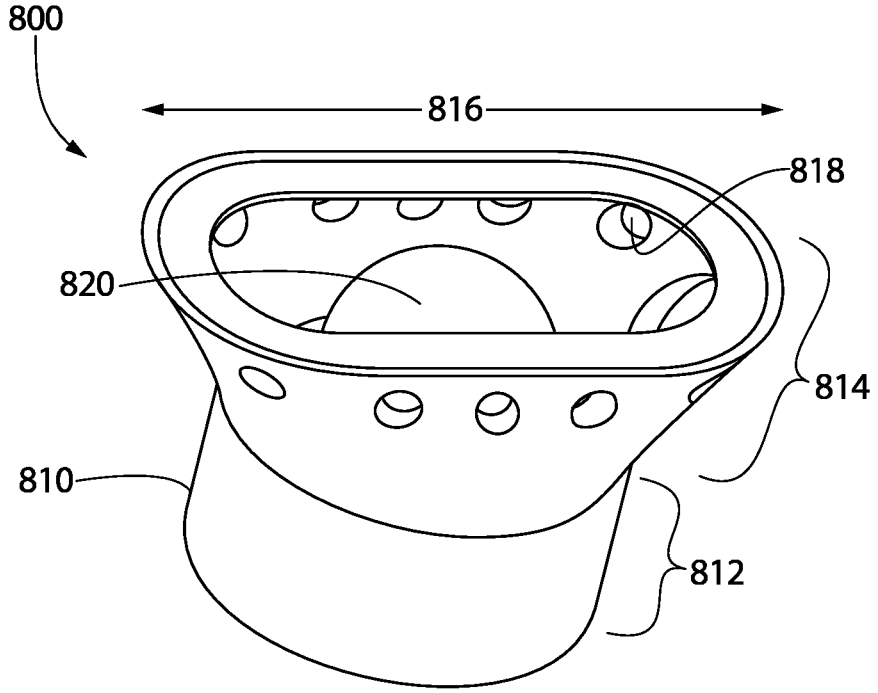
FIG. 8 illustrates a perspective view of a valve, according to an embodiment.

FIG. 8 illustrates a perspective view of the valve 800, according to an embodiment. The valve 800 may include a body 810 having a bore formed axially-therethrough. The body 810 may include a first (e.g., lower) portion 812 and a second (e.g., upper) portion 814. The first portion 812 may be sized to fit within one of the openings 113 in the base pipe 112 or the openings 133 in the base pipe 132. The second portion 814 may be tapered. More particularly, a cross-sectional length 816 of the second portion 814 may increase proceeding away from the first portion 812. The second portion 814 may also have one or more openings 818 formed radially-therethrough. As mentioned above, the valve 800 may be a check valve. Thus, the valve 800 may have an impediment 820 positioned at least partially therein. As shown, the impediment 820 may be a ball.

Figure 9:
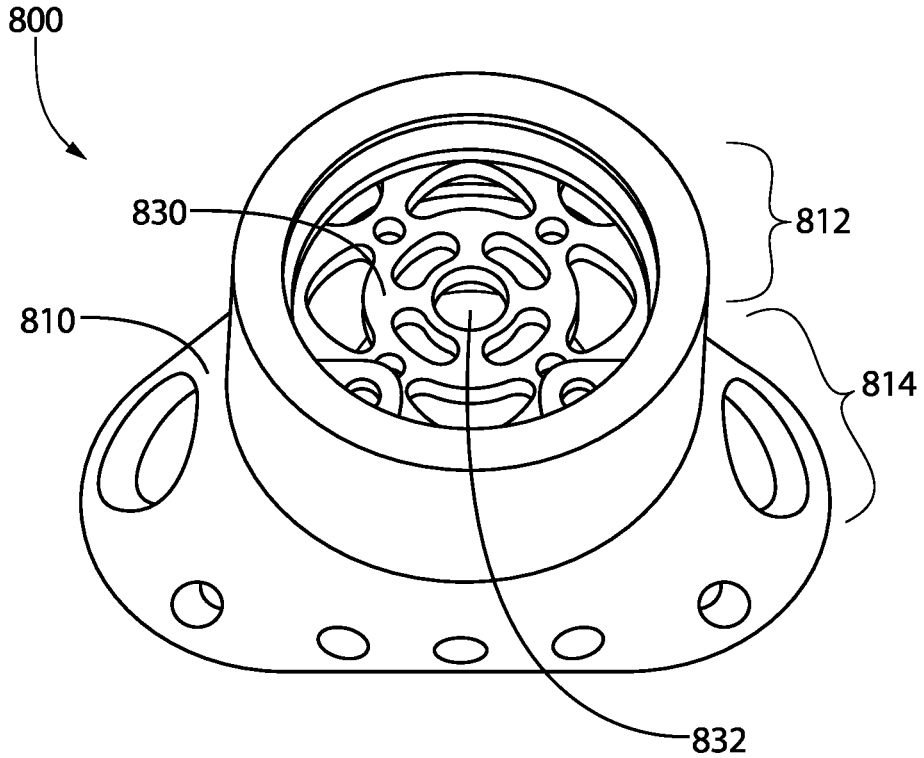
FIG. 9 illustrates another perspective view of the valve shown in FIG. 8, according to an embodiment.

FIG. 9 illustrates another perspective view of the valve 800, according to an embodiment. The dissolvable insert 830 may be positioned at least partially within the first (e.g., lower) portion 812 of the body 810. The dissolvable insert 830 may be substantially flat (e.g., a plate). The dissolvable insert 830 may have one or more openings 832 formed axially-therethrough.

Figure 10:
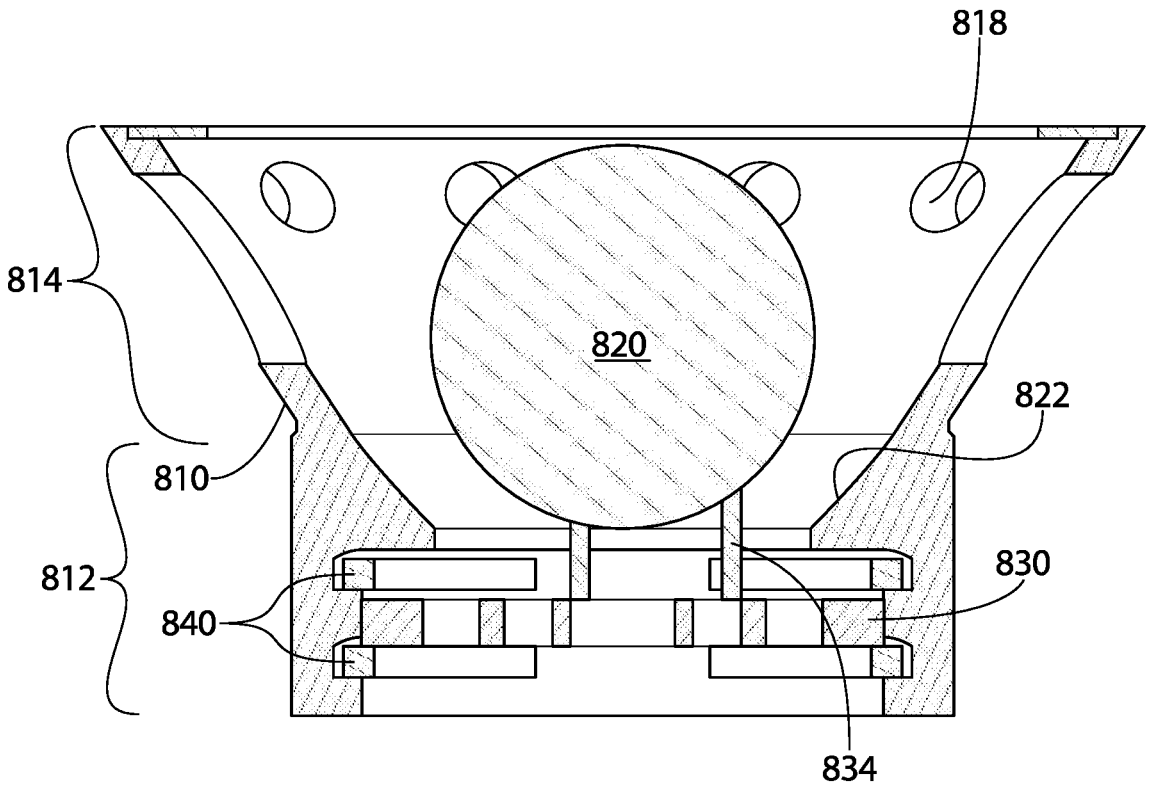
FIG. 10 illustrates a cross-sectional side view of the valve shown in FIG. 8, according to an embodiment.

FIG. 10 illustrates a cross-sectional side view of the valve 800, according to an embodiment. An inner surface of the body 810 may define a seat 822. As shown, the impediment 820 may initially be held away from (e.g., above) the seat 822 by the dissolvable insert 830. For example, the dissolvable insert 830 may be positioned below the seat 822 and include one or more axial protrusions 834 that hold the impediment 820 away from (e.g., above) the seat 822. In another embodiment, the dissolvable insert 830 may be positioned above the seat 822 and thus be able to hold the impediment 820 away from (e.g., above) the seat 822. In this embodiment, the protrusions 834 may be omitted.

When the impediment 830 is held away from the seat 822, fluid may flow through the valve 800 in both axial directions. However, when the dissolvable insert 830 at least partially dissolves, the impediment 820 may be configured to contact the seat 822. Thus, when the dissolvable insert 830 at least partially dissolves, the valve 800 may function as a check valve by allowing fluid to flow therethrough in one axial direction (e.g., radially-outward through the base pipe 112, 132) but preventing fluid from flowing therethrough in the opposing axial direction (e.g., radially-inward through the base pipe 112, 132).

The dissolvable insert 830 may be held in place by one or more snap rings (two are shown: 840). The dissolvable insert 830 may be positioned axially-between the two snap rings 840. The snap rings 840 may be positioned at least partially within circumferential recesses formed in the inner surface of the body 810. In another embodiment, the snap rings 840 may be omitted, and the dissolvable insert 830 may be positioned at least partially within a circumferential recess formed in the inner surface of the body 810.

Figure 11:
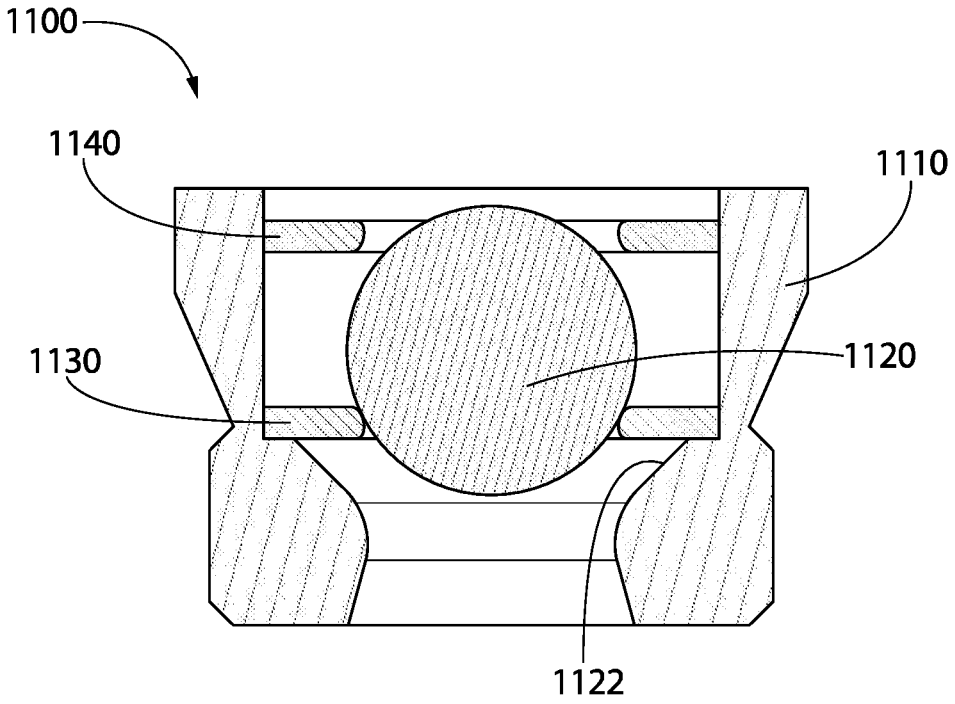
FIG. 11 illustrates a cross-sectional side view of another valve, according to an embodiment.
Figure 12:
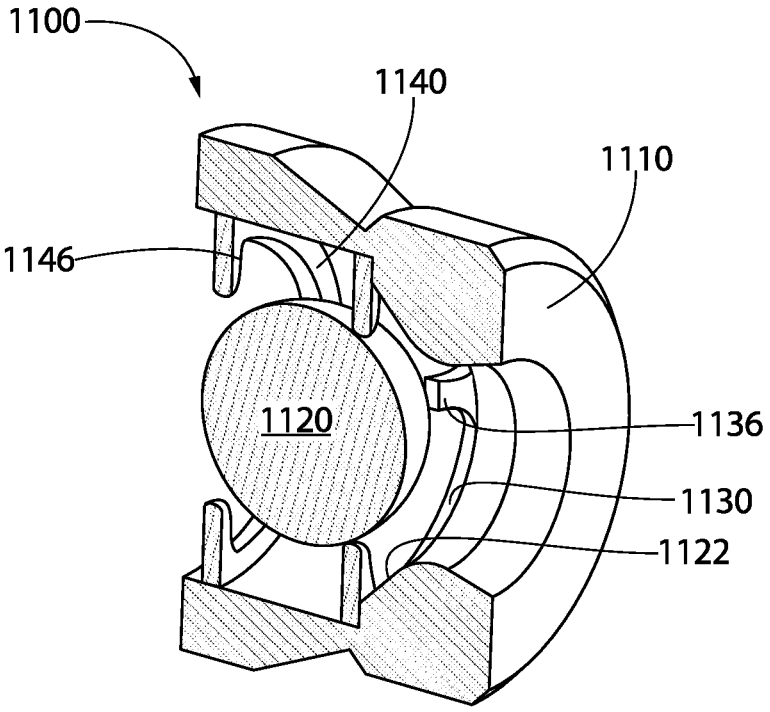
FIG. 12 illustrates a cross-sectional view taken through line 12-12 in FIG. 11, according to an embodiment.

FIG. 11 illustrates a cross-sectional side view of another valve 1100, and FIG. 12 illustrates a cross-sectional view of the valve 1100 taken through line 12-12 in FIG. 11, according to an embodiment. The valve 1100 may be the same as the valve 800, or it may be different. The valve 1100 may be used instead of, or in addition to, the valve 800. The valve 1100 may also include a body 1110 having a bore formed axially-therethrough. An inner surface of the body 1110 may define a seat 1122. The dissolvable insert 1130 may be positioned within the body 1110 and above the seat 1122. As shown, the dissolvable insert 1130 may rest/sit on the seat 1122. The dissolvable insert 1130 may have one or more arms 1136 that extend radially-inward therefrom. The arms 1136 may be configured to hold the impediment 1120 away from the seat 1122. Between the arms 1136, the dissolvable insert 1130 may have one or more openings 1132 formed axially-therethrough.

A retaining plate 1140 may also be positioned within the body 1110. The impediment 1120 may be positioned axially-between the dissolvable insert 1130 and the retaining plate 1140. The retaining plate 1140 may have one or more arms 1146 that extend radially-inward therefrom. The arms 1146 may be configured to hold the impediment 1120 within the valve 1100. Between the arms 1146, the retaining plate 1140 may have one or more openings 1142 formed axially-therethrough. Thus, fluid may flow through the valve 1100 in both axial directions prior to the dissolvable insert 1130 dissolving. However, after the dissolvable insert 1130 at least partially dissolves, the valve 1100 may function as a check valve by allowing fluid to flow therethrough in one axial direction but preventing fluid from flowing therethrough in the opposing axial direction.

Figure 13:
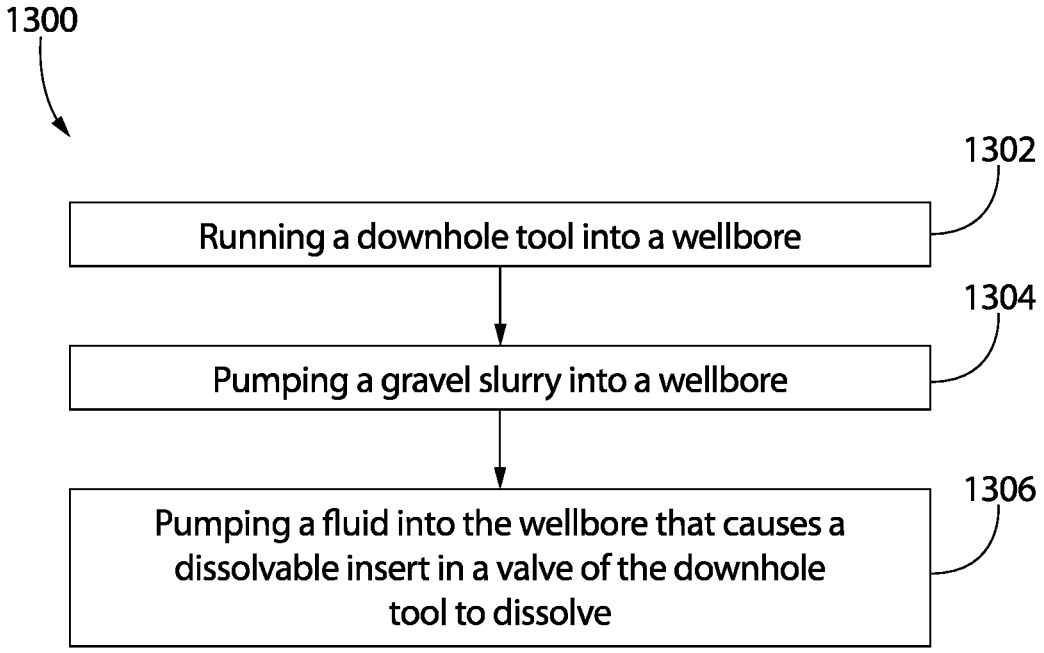
FIG. 13 illustrates a flow chart of a method for gravel packing a wellbore using the downhole tool disclosed herein, according to an embodiment.

FIG. 13 illustrates a flow chart of a method 1300 for gravel packing a wellbore, according to an embodiment. The method 1300 may include running the downhole tool 100, 500 into the wellbore, as at 1302. The method 1300 may also include pumping a gravel slurry into the wellbore, as at 1304. The gravel slurry may include gravel particles dispersed in a carrier fluid. The carrier fluid may flow radially-inward through the screens 120 while the gravel particles remain positioned radially-between the screens 120 and the wall of the wellbore. A portion of the carrier fluid may flow through the ICDs 116 in the base pipe 112 and into the annulus 138 between the wash pipe 108 and the base pipe 112. Another (e.g., greater) portion of the carrier fluid may flow through the valves 800, 1100. As shown in FIG. 1, in one embodiment, the carrier fluid may flow through the shunt tubes 124 and into the return flow unit 130, where the carrier fluid may flow through the valves 800, 1100. As shown in FIG. 5, in another embodiment, the carrier fluid may flow through the valves 800, 1100 that are in the same base pipe 112 as the ICD(s) 116.

In at least one embodiment, the dissolvable inserts 830, 1130 may dissolve after a predetermined amount of time in contact with fluids in the wellbore (e.g., oil or water). In another embodiment, the dissolvable inserts 830, 1130 may dissolve after a predetermined amount of time in contact with the gravel slurry. In yet another embodiment, after the gravel slurry has been pumped, the method 1300 may include pumping a fluid (e.g., an acid) into the wellbore to cause the dissolvable inserts 830, 1130 to dissolve, as at 1306. The fluid pumped into the wellbore may flow through the ICDs 116 and the valves 800 in the same manner as the carrier fluid. As discussed above, once the dissolvable inserts 830, 1130 dissolve, the valves 800, 1100 may become check valves that prevent fluid from flowing radially-inward therefrom.

As will be appreciated, both the ICDs 116 and the valves 800, 1100 may allow fluid to flow radially-inward therethrough during the gravel packing operation, but once the wellbore starts producing, the hydrocarbons may flow through the ICDs 116 but not the valves 800, 1100.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A downhole tool, comprising:

a base pipe having a first opening formed radially-therethrough; and a valve positioned at least partially within the first opening, wherein the valve comprises a dissolvable insert and an impediment, wherein the dissolvable insert prevents the impediment from contacting a seat of the valve such that the valve permits fluid flow in both axial directions through the valve, and wherein, after the dissolvable insert dissolves, the impediment is configured to contact the seat such that the valve permits fluid flow in one axial direction through the valve but prevents fluid flow in the opposing axial direction through the valve, wherein the valve comprises a first portion having a substantially constant cross-sectional length, and a second portion having a cross-sectional length that increases proceeding away from the first portion, wherein the dissolvable insert has one or more openings formed axially-therethrough, wherein the seat is positioned between the dissolvable insert and the impediment, and wherein the dissolvable insert comprises an axial protrusion that contacts the impediment and prevents the impediment from contacting the seat, wherein an inner surface of the valve defines first and second recesses that are axially-offset from one another, wherein a first ring is positioned at least partially within the first recess, wherein a second ring is positioned at least partially within the second recess, and wherein the dissolvable insert is positioned axially between the first and second rings.

2. The downhole tool of claim 1, wherein the second portion has an opening formed radially-therethrough.

3. The downhole tool of claim 1, wherein the base pipe has a second opening formed radially-therethrough, and wherein an inflow control device is positioned at least partially within the second opening.

4. The downhole tool of claim 3, further comprising a housing positioned radially-outward from the base pipe.

5. The downhole tool of claim 4, wherein a portion of the valve extends radially-outward from the base pipe and toward the housing, and wherein a gap exists between the valve and the housing.

6. A downhole tool, comprising:

a first base pipe having one or more first openings formed radially-therethrough;

an inflow control device positioned at least partially in each of the first openings;

a screen coupled to the first base pipe and positioned radially-outward from the first base pipe;

a second base pipe coupled to the first base pipe, the second base pipe having one or more second openings formed radially-therethrough; and a valve positioned at least partially in each of the second openings, wherein the valve comprises a dissolvable insert and an impediment, wherein the dissolvable insert prevents the impediment from contacting a seat of the valve such that the valve permits fluid flow in both axial directions through the valve, and wherein, after the dissolvable insert dissolves, the impediment is configured to contact the seat such that the valve permits fluid flow in one axial direction through the valve but prevents fluid flow in the opposing axial direction through the valve, wherein the valve comprises a first portion having a substantially constant cross-sectional length, and a second portion having a cross-sectional length that increases proceeding away from the first portion, wherein the dissolvable insert has one or more openings formed axially-therethrough, wherein the seat is positioned between the dissolvable insert and the impediment, and wherein the dissolvable insert comprises an axial protrusion that contacts the impediment and prevents the impediment from contacting the seat, wherein an inner surface of the valve defines first and second recesses that are axially-offset from one another, wherein a first ring is positioned at least partially within the first recess, wherein a second ring is positioned at least partially within the second recess, and wherein the dissolvable insert is positioned axially between the first and second rings.

7. The downhole tool of claim 6, further comprising:

a housing positioned radially-outward from the second base pipe; and a shunt tube that places a first annulus formed between the first base pipe and the screen in fluid communication with a second annulus formed between the second base pipe and the housing.

8. The downhole tool of claim 7, wherein the housing does not have openings formed radially-therethrough.

9. The downhole tool of claim 7, wherein a portion of the valve extends radially-outward from the second base pipe and toward the housing, and wherein a gap exists between the valve and the housing.

10. The downhole tool of claim 6, wherein the one or more second openings have a greater aggregate surface area than the one or more first openings.

11. The downhole tool of claim 6, wherein the second portion has an opening formed radially-therethrough.

12. A method for gravel packing a wellbore, comprising:

running a downhole tool into a wellbore, wherein the downhole tool comprises:

a base pipe having a first opening and a second opening formed radially-therethrough, wherein an inflow control device is positioned at least partially in the first opening, wherein a valve is positioned at least partially in the second opening, and wherein the valve comprises a first portion having a substantially constant cross-sectional length, and a second portion having a cross-sectional length that increases proceeding away from the first portion; and a screen positioned radially-outward from the first opening, the second opening, or both; and pumping a gravel slurry into the wellbore, wherein the gravel slurry comprises particles dispersed in a carrier fluid, wherein the carrier fluid flows through the screen, wherein a first portion of the carrier fluid flows through the inflow control device and a second portion of the carrier fluid flows through the valve, wherein the valve comprises a dissolvable insert and an impediment, the dissolvable insert having one or more openings formed axially-therethrough and an axial protrusion that contacts the impediment and prevents the impediment from contacting a seat of the valve such that that the valve permits fluid flow in both axial directions through the valve, and wherein, after the dissolvable insert in the valve dissolves, the impediment in the valve is configured to prevent fluid through the valve in one direction, wherein an inner surface of the valve defines first and second recesses that are axially-offset from one another, wherein a first ring is positioned at least partially within the first recess, wherein a second ring is positioned at least partially within the second recess, and wherein the dissolvable insert is positioned axially between the first and second rings.

13. The method of claim 12, further comprising pumping a fluid into the wellbore after pumping the gravel slurry into the wellbore, wherein the dissolvable insert dissolves after being in contact with the fluid for a predetermined amount of time that is less than 1 day.

14. The method of claim 12, wherein the second portion of the carrier fluid flows through a shunt tube prior to reaching the valve, and wherein the second portion of the carrier fluid is greater than the first portion of the carrier fluid.

* * * * *